United States Patent [19]

Tyler

[11] Patent Number: 4,475,886

[45] Date of Patent: Oct. 9, 1984

[54] LIFTER FOR ROTARY KILN

[75] Inventor: Gary A. Tyler, Poland, Ohio

[73] Assignee: Kaiser Aluminum & Chemical Corporation, Oakland, Calif.

[21] Appl. No.: 471,368

[22] Filed: Mar. 1, 1983

[51] Int. Cl.[3] ..... F27B 7/14; F27B 7/28; F23M 5/02

[52] U.S. Cl. ..... 432/118; 110/338; 432/119

[58] Field of Search ..... 432/118, 119; 110/338

[56] References Cited

U.S. PATENT DOCUMENTS 1,065,597 6/1913 Edison ..... 432/69
1,920,677 8/1933 Burke ..... 432/118
3,455,099 5/1969 Olsen et al. ..... 432/118
4,136,965 1/1979 Sunnergren ..... 366/25

FOREIGN PATENT DOCUMENTS 2446705 4/1976 Fed. Rep. of Germany ..... 432/119

*Primary Examiner*—John J. Camby
*Attorney, Agent, or Firm*—Malcolm McQuarrie

[57] ABSTRACT

An improved lifter for a rotary kiln is made by extending the internal reinforcement all the way to the inner face of the lifter and by locating the junction between the branches and the main stem of the lifter closer to the metal shell of the rotary kiln than is the hot, inner face of the refractory lining adjacent to the lifter.

3 Claims, 5 Drawing Figures

LIFTER FOR ROTARY KILN

BACKGROUND OF THE INVENTION

Lifters in rotary kilns have been known for many years; see U.S. Pat. No. 1,065,597 to Thomas A. Edison. However, improvements continue to be made in these devices and the method of forming them; see U.S. Pat. No. 3,445,099 and U.S. Pat. No. 4,136,965.

One of the problems which occurs with such refractory lifters is that they disintegrate prematurely, both by spalling away of the inner face of the lifter and also by cracking off of the lifter at a point between the inner end of the lifter and the plane of the inner surface of the surrounding refractory lining.

The present invention, which concerns the structure and location of anchors used to reinforce refractory lifters and attach them to the metal shell of the kiln, is directed to a solution of this problem of premature disintegration.

SUMMARY OF THE INVENTION

It has now been found, according to this invention, that an improved refractory lifter with embedded metal anchor having a plurality of branches at its outer end is formed when at least some of the branches extend to the inner face of the lifter and the point at which the branches commence is closer to the metal shell then is the hot face of the refractory lining adjacent to the lifter.

DETAILED DESCRIPTION

Figure 1:
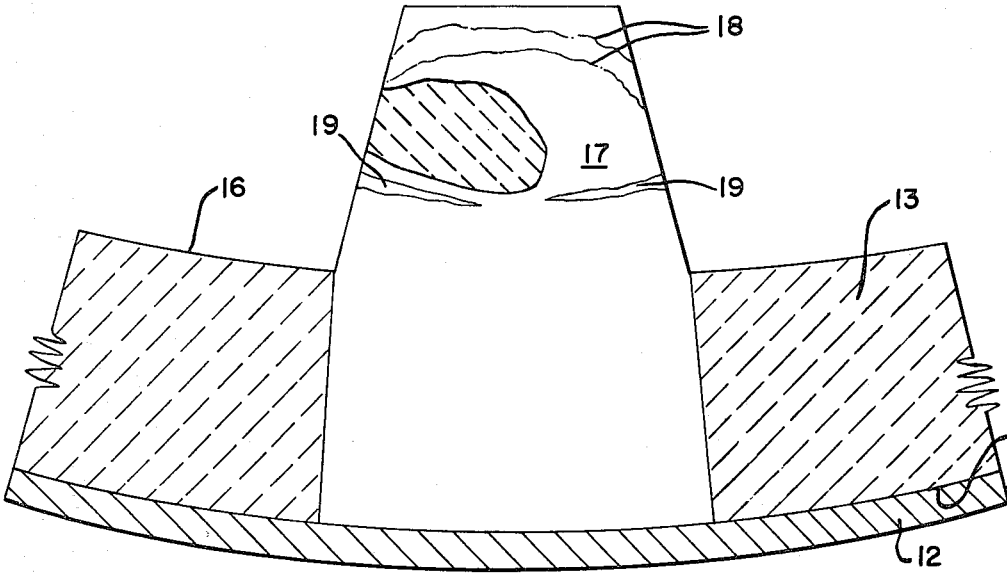
FIG. 1 (PRIOR ART)
FIG. 1 is a sectional view of a portion of a rotary kiln showing the refractory lining and a lifter, and indicating two different modes of failure.

FIG. 1 indicates the environment of the present invention, showing a portion of a rotary kiln 11 comprising a metal shell 12 and refractory lining 13. As will be evident, lining 13 has an outer, cold face 14 adjacent shell 12, and an inner, hot face 16 spaced inwardly from metal shell 12.

A portion of refractory lining 13 extends inwardly from inner face 16 to form a lifter 17. The portion of lifter 17 extending inwardly from face 16 is shown as having a trapezoidal cross section, but any desired cross section can be used; see U.S. Pat. No. 4,136,965 for an alternative configuration.

Small lines 18 and cracks 19 indicate the two modes of failure of such lifters which the present invention overcomes. Small lines 18 represent slabbing away of the inner face of the lifter, and cracks 19 indicate bodily parting of the inner portion of the lifter from its base.

The present invention can be used with case-in-place lifters such as shown in U.S. Pat. No. 3,445,099 and also with preformed lifters, that is to say lifters which are formed outside the kiln and then placed in the kiln. The lifters may also be either superimposed lifters, that is lifters which sit on top of the main lining of the kiln, or may extend all the way to the kiln shell. Both types of lifter are shown in U.S. Pat. No. 4,136,965.

Figure 2A:
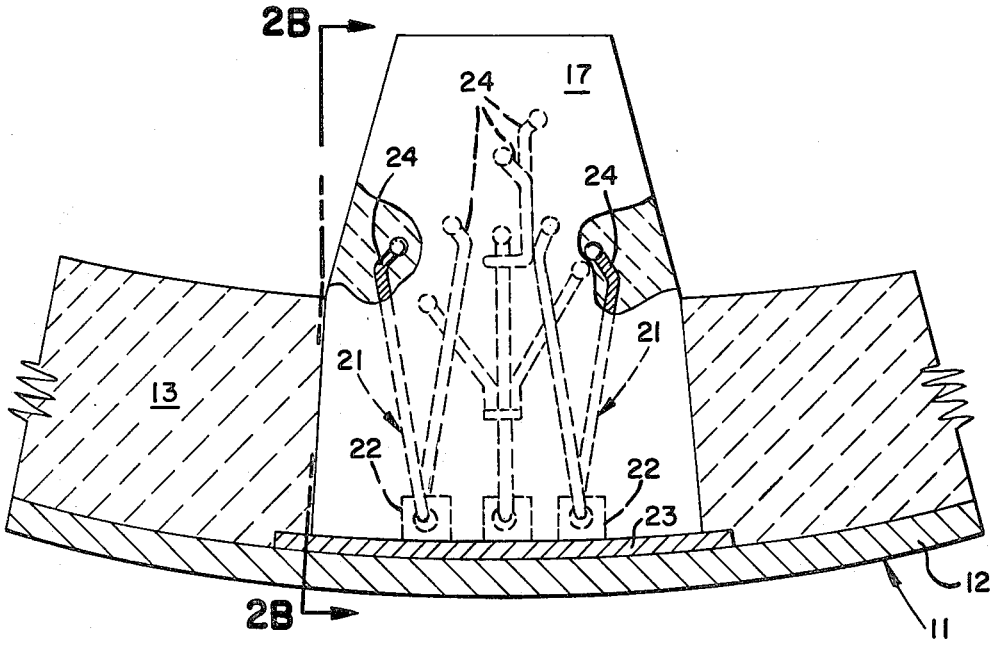
FIG. 2A (PRIOR ART)
FIG. 2A is a sectional view of a lifter showing the prior art method of reinforcing and anchoring.
Figure 2B:
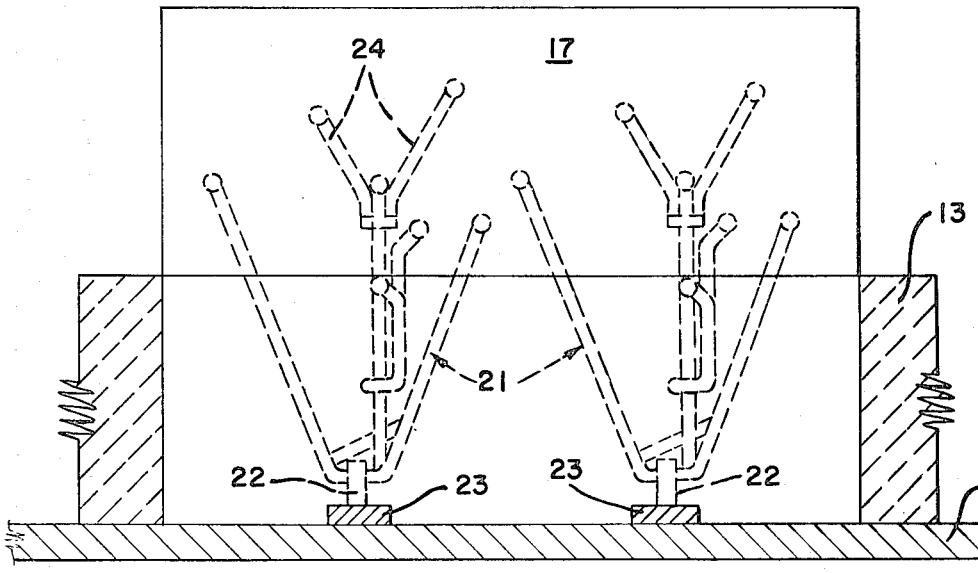
FIG. 2B (PRIOR ART)
FIG. 2B is a sectional view along the line 2B—2B of FIG. 2A.
Figure 3A:
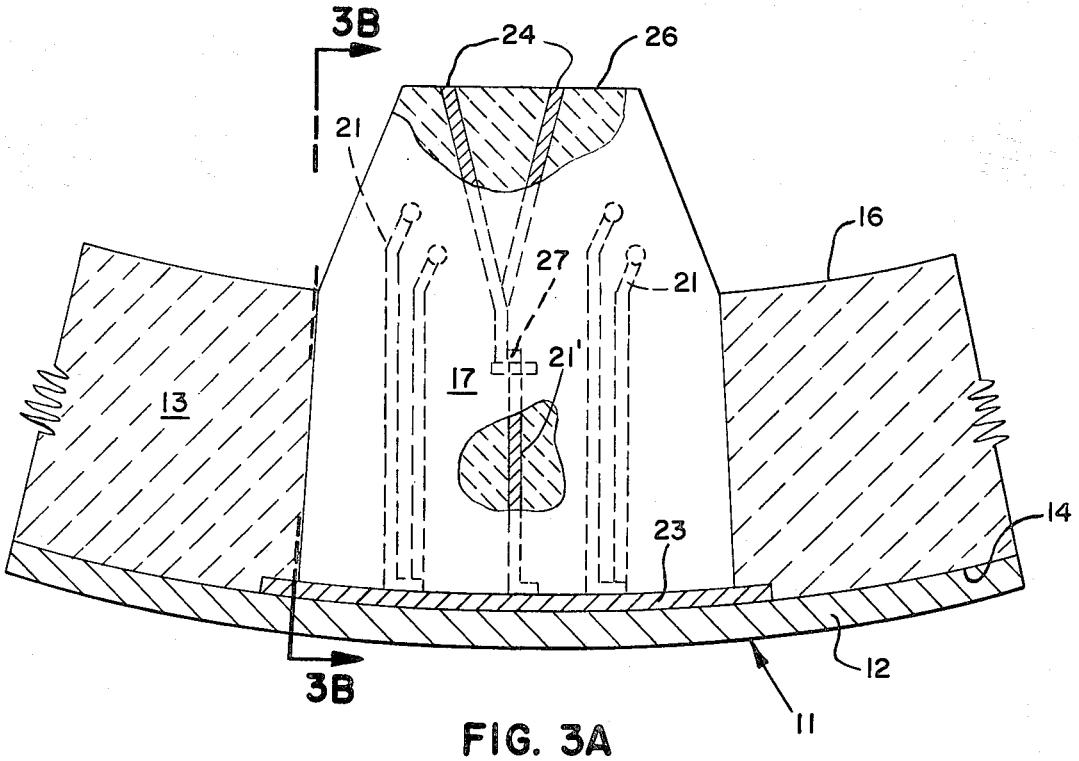
FIG. 3A is a sectional view of a lifter constructed according to the present invention.
Figure 3B:
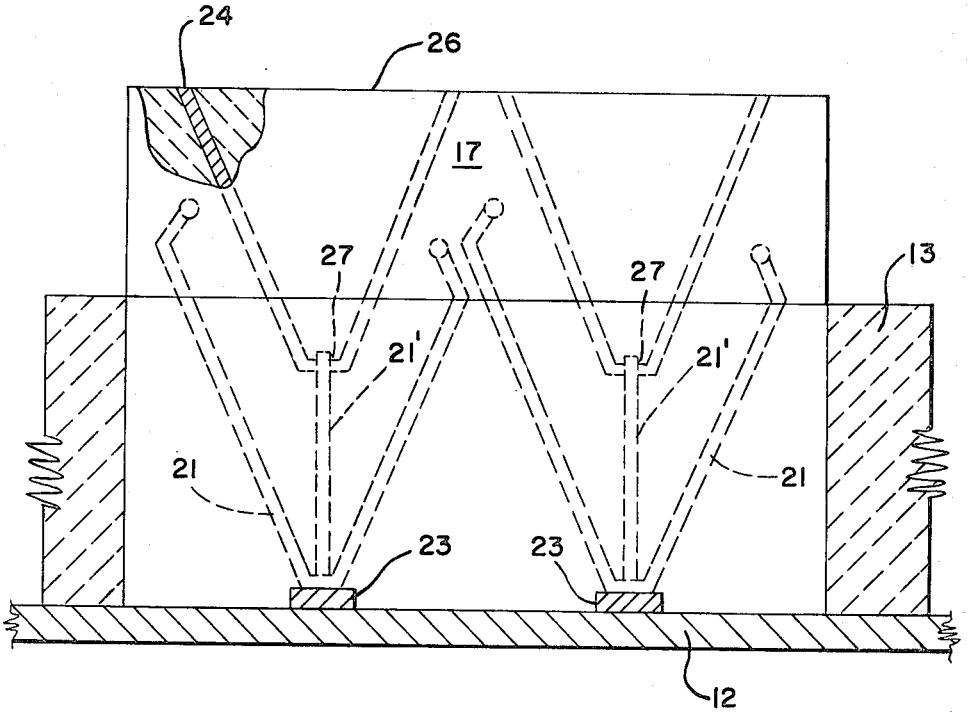
FIG. 3B is a sectional view along the line 3B—3B of FIG. 3A.

FIG. 2 indicates in more detail the reinforcement/anchoring system used in prior art lifters. Essentially these are reinforcing wires 21 which are attached to kiln shell 12, for example by being looped through nuts 22 welded to a strap 23 which can be attached to shell 12, for example by welding, before the remainder of the refractory lining is put in place. Alternatively, as shown in FIG. 3, wires 21 may be attached (e.g., welded) directly to strap 23. It will be noted that a single anchor or reinforcement 21 has several branches 24. In the anchoring system according to the present invention, shown in FIG. 3, at least some of reinforcements 21, indicated by 21', and more specifically branches 24, extend to the inner face 26 of lifter 17.

It will also be noted that in the embodiment shown in FIG. 3 all branch points 27 of anchor 21 lie closer to kiln shell 12 than does inner face 16 of the refractory lining adjacent lifter 17. This is not true of the prior art embodiment shown in FIG. 2. It is believed that extending anchors 21' to inner face 26 of lifter 17 reduces the hot face spalling indicated by spall lines 18. Also, it is believed that locating branching points 27 below the general surface of the inner face of refractory lining 13 greatly reduces the occurrence of cracks such as those shown at 19.

As is known, reinforcements 21 may be made of any desired material, for example steel, and are preferably made of stainless steel, for example quality 304 or 310 stainless steel. The refractory lining and lifter may be made of any desired material, for example a high alumina castable refractory. Alternatively, the metal anchors shown, particularly central anchors 21', may be replaced by ceramic anchors which, again, in the practice of this invention will extend all the way to inner face 26 of lifter 17; however, is this embodiment, the ceramic anchors will generally not have branches.

I claim:

1. In a rotary kiln comprising a cylindrical metal shell and a refractory lining on the interior thereof, said lining having an outer, cold face adjacent the metal shell and an inner, hot face, a limited portion of said lining extending inwardly of the hot face to form at least one lifter, each such lifter containing at least one imbedded anchor, the improvement wherein said anchor is a metal anchor attached to the metal shell of the kiln, and having a plurality of branches at its end remote from the kiln shell, said branches being located at a point closer to the metal shell than is the hot face of the refractory lining adjacent to the lifter, and wherein said anchor extends to the inner face of the lifter.

2. Rotary kiln according to claim 1 wherein each lifter has at least two anchors.

3. Rotary kiln according to claim 1 wherein the lifter is structurally separate from the adjacent lining.

* * * * *